US010602849B2

(12) United States Patent
Cass

(10) Patent No.: US 10,602,849 B2
(45) Date of Patent: Mar. 31, 2020

(54) ACTIVE SITTING DEVICE WITH CENTRAL PIVOT

(71) Applicant: Aaron Flax Cass, Exeter, NH (US)

(72) Inventor: Aaron Flax Cass, Exeter, NH (US)

( * ) Notice: Subject to any disclaimer, the term of this patent is extended or adjusted under 35 U.S.C. 154(b) by 0 days.

(21) Appl. No.: 16/024,813

(22) Filed: Jun. 30, 2018

(65) Prior Publication Data

US 2019/0000235 A1 Jan. 3, 2019

Related U.S. Application Data

(60) Provisional application No. 62/527,541, filed on Jun. 30, 2017.

(51) Int. Cl.

| | |
|---|---|
| ***A47C 9/00*** | (2006.01) |
| ***A47C 7/18*** | (2006.01) |
| ***A47C 3/18*** | (2006.01) |
| ***A47C 3/025*** | (2006.01) |

(52) U.S. Cl.

CPC ..... *A47C 9/002* (2013.01); *A47C 3/0255* (2013.01); *A47C 3/185* (2013.01); *A47C 7/18* (2013.01)

(58) Field of Classification Search

CPC ..... A47C 9/002; A47C 3/0255; A47C 3/185; A47C 7/18

USPC ..... 297/313, 314

See application file for complete search history.

(56) References Cited

U.S. PATENT DOCUMENTS 1,070,278 A * 8/1913 McKinney ..... B60N 2/505 297/314 X 5,524,967 A * 6/1996 Glockl ..... A47C 9/002 248/372.1

* cited by examiner

*Primary Examiner* — Anthony D Barfield

(57) ABSTRACT

A sitting device that encourages the active engagement of the user to remain upright. A seat (14) supported by a central column (12) passes through a pivot joint (16) supported by a base (10). The pivot joint (16) is located substantially at the median of the central column (12) between the seat (14) and the bottom of the base (10). The central column (12) pivots angularly providing the user mobility in his or her hips and lumbar, thoracic, and cervical spine. The central column (12) and seat (14) are brought back to vertical when the sitting device is not in use by means of a counterweight (18) affixed to the bottom of the central column (12). The length of the central column (12) may be adjustable to allow the user to select the desired height of the seat (14). The pivot joint (16) may be a spherical plain bearing, spherical ball bearing, gimbal bearing, spherical thrust bearing, or other device that allows the central column (12) to pivot angularly. The base (10) supporting the pivot joint (16) and central column (12) may contain as few as one leg and as many legs as needed to support the user. The movement of the pivot joint (16) may be inhibited by affixing a collar lock (40). The frictional resistance of the pivot joint (16) may be adjusted with a set screw (50).

12 Claims, 7 Drawing Sheets

ACTIVE SITTING DEVICE WITH CENTRAL PIVOT

BACKGROUND—PRIOR ART

US Patents

| Pat. No. | Issue Date | Patentee |
|---|---|---|
| 7,387,339 | Jun. 17, 2008 | Bykov et al. |
| 4,807,841 | Feb. 28, 1989 | Edstrom |
| 5,746,481 | May 5, 1998 | Obermeir |
| 4,099,697 | Jul. 11, 1978 | Von Shuckmann |
| 5,921,628 | Jul. 13, 1999 | Glockl |
| 9,060,612 | Jun. 23, 2015 | Lee |
| 9,010,867 | Apr. 21, 2015 | Martin et al. |
| 3,863,587 | Feb. 4, 1975 | Bosnich |

Foreign Patents

| Patent Number | Issue Date | Patentee |
|---|---|---|
| 2988628 (EPO) | Feb. 15, 2017 | Hugou et al. |
| 1997403 (EPO) | Dec. 3, 2008 | Lenz et al. |

As we spend more and more time using computers, smartphones, tablets, and other devices, we inevitably end up spending more time sitting. Because prolonged sitting is uncomfortable, furniture manufacturers have developed ergonomically contoured, supportive chairs intended to help us through the day. Though these chairs are well intentioned, the more time we sit passively with back support, the weaker our postural muscles become. Spending large amounts of time sitting passively tends to lead to postural degeneration and back pain. Furthermore, prolonged sitting has been correlated with increased risk of obesity, heart disease, cancer, and all-cause mortality.

Many furniture designers have become aware of the issues associated with passive sitting and have tried to solve the problem by creating devices that encourage people to sit actively. Though progress has been made, the sitting devices currently available have a variety of limitations.

One basic improvement over the traditional passive sitting device is to provide ways for the seat of the chair or stool to angle forward, opening up the hips to greater than 90 degrees in relation to the torso. Sitting with more open hips takes strain off the lower back, lengthens the hip flexors, and opens up the front of the body reducing compression of the user's internal organs. U.S. Pat. No. 7,387,339 to Bykov et al. (2008) and U.S. Pat. No. 4,807,841 to Edstrom (1989) allow for forward tilt while sitting. Though these sitting devices allow for a more open sitting angle, as conventional seats with backrests they discourage the user from actively supporting him or herself, and the user tends to slouch backward with extended sitting time.

A number of sitting devices have been made that open the angle of the user's pelvis and encourage active, dynamic sitting by allowing movement at the base of the central column. U.S. Pat. No. 5,746,481 to Obermeir (1998), U.S. Pat. No. 4,099,697 to Von Shuckmann (1978), and U.S. Pat. No. 5,921,628 to Glockl (1999) pivot angularly at or near the base of the central column allowing the user whole-body movement and encouraging the user to engage his or her legs while sitting. Though these types of sitting devices allow the user a wider range of whole-body movement than those described in the previous paragraph, they have two disadvantages. First, they rely on springs or elastic elements to bring the central shaft back to upright. Consequently, to whatever extent the user moves the seat and central column out of vertical alignment, his or her movement is met with greater mechanical resistance, reducing the need for the user to engage his or her core to remain upright. Secondly, the seats are rigidly set at ninety degrees to the central column allowing for limited freedom of movement of the user's pelvis and lumbar, thoracic, and cervical spine independent of the tilting of the central column.

U.S. Pat. No. 9,060,612 to Lee (2015) and U.S. Pat. No. 4,807,841 to Edstrom (1989) pivot just under the seat. These sitting devices afford the user an increased range of motion in the pelvis and lumbar, thoracic, and cervical spine front-to-back and side-to-side. However, because they include a base rigidly fixed at a right angle to the ground, they don't allow for the larger whole-body movements of the sitting devices mentioned in the previous paragraph.

European Patent Office patent 1997403 to Lenz et al. (2008) and U.S. Pat. No. 9,010,867 to Martin et al. (2015) afford the user a large range of motion by providing a base with a convex shape. These sitting devices don't rely on springs or other elastic mechanisms to return the central column and seat to upright. Instead, by virtue of their curved bases they come back to vertical alignment by means of gravity. Though this type of sitting device offers little resistance to off-axis tilt, because the base rolls in whatever direction the user leans, the result is that the user effectively has a solid support structure directly under where he or she sits requiring limited engagement of the legs and core muscles to remain upright.

European Patent Office patent 2988628 to Hugou et al. (2017) pivots freely at the base and allows for some pelvic, lumbar, and thoracic mobility by virtue of its small seat. However, the disadvantage of this sitting device is that it is unable to remain standing on its own, and it does not come back to vertical without the user picking up the device and placing it under him or her before sitting. Furthermore, the small sitting surface of the seat will tend to become uncomfortable with extended sitting.

Lastly, U.S. Pat. No. 3,863,587 to Bosnich (1975) pivots angularly between the seat and floor by means of a ball and socket joint, and a counterweight below the central pivot helps bring the seat to upright. Though this sitting device accommodates a wide range of motion and is self righting, it is intended for use by captains on ships to keep them upright while the boat pitches and rolls with the movement of the sea. To insure the user remains upright with as little effort as possible, the shaft below the ball and socket joint accommodates multiple weights.

To this end, U.S. Pat. No. 3,863,587 to Bosnich (1975) from the previous paragraph states, "Sufficient weights are added to more than counterbalance the weight of the occupant of the chair. More accurately, the weight of the occupant times the distance of the occupants [sic] center of gravity to the center of motion to the ball and socket joint must be less than the counterbalancing weights times the distance of their center of gravity to said center of motion. The occupant of the chair remains vertical with the horizon regardless of the roll and pitch of the ship." Hence, the intended purpose of this sitting device is to reduce the activity needed by the user to remain upright. Furthermore, this sitting device has a backrest, demonstrating it is not intended to encourage active sitting.

In conclusion, insofar as I am aware, no sitting device formerly developed provides a sitting experience which:

1. allows the user to sit with a greater than ninety degree angle of the hips
2. requires the user to engage his or her legs and core muscles to remain upright,
3. allows for a wide range of movement in the user's pelvis and lumbar, thoracic, and cervical spine,
4. offers minimal resistance to the angular movement of the seat and central column,
5. returns the seat and central column to upright when not in use,
6. stands on its own, and
7. is intended to encourage active sitting.

SUMMARY

An improved sitting device provides a means for the user to remain active with large movements of the whole body involving the user's legs and core muscles. It lets the user sit with a greater than ninety degree angle of the hips. Such a device allows for at least 10 degrees of angular movement of the seat and central column off the vertical axis, while affording the user a wide range of movement of the hips and lumbar, thoracic, and cervical spine. Furthermore, an improved sitting device stands on its own and returns to vertical exerting minimal resistance to the angular movement of the seat and central column off of the vertical axis. Such a sitting device has the advantage of requiring the continuous, active engagement of the user to remain balanced and upright using his or her legs and core muscles.

| Drawings - Reference Numerals | |
|---|---|
| 10 | base |
| 12 | central column |
| 14 | seat |
| 16 | pivot joint |
| 18 | counterweight |
| 20 | lever |
| 22 | mounting plate |
| 24 | gas lift cylinder |
| 26 | piston |
| 27 | support can |
| 28 | flange |
| 32A | spherical plain bearing |
| 32B | spherical plain race |
| 36 | conical recession |
| 38 | cylindrical recession |
| 40 | collar lock |
| 42 | pan head screw |
| 44 | keyhole slot |
| 50 | set screw with knob handle |
| 52 | threaded hole |

DRAWINGS—FIGURES

DETAILED DESCRIPTION

Figure 1:
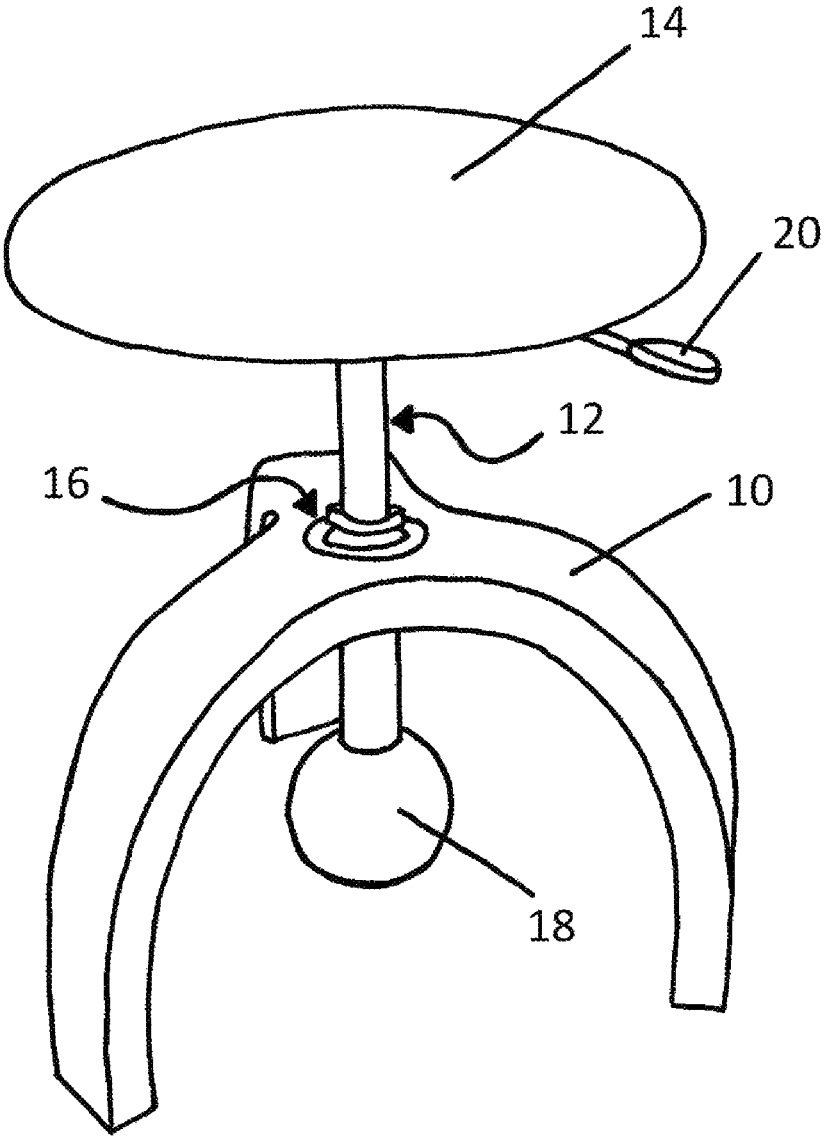
FIG. 1 is an isometric view of the sitting device, constructed in accordance with one embodiment.

One embodiment of the sitting device is illustrated in FIG. 1 (isometric view). The sitting device is shown with a central column 12 in vertical alignment. A seat 14 is affixed atop the central column 12. The central column 12 passes through and is supported by a pivot joint 16. The pivot joint 16 is flush mounted and affixed at the top center of a base 10. The pivot joint 16 is located substantially at the median of the central column 12 between the seat 14 and the bottom of the base 10. A counterweight 18 of approximately 3.5 kg is affixed to the bottom of the central column 12. The central column 12 is afforded a 10-20 degree range of angular movement off of the vertical axis by virtue of the movement of the pivot joint 16.

The padding of the seat 14 in the embodiment shown in FIG. 1 is made of firm polyethylene foam, covered in cotton duck, and affixed in place with upholstery tacks. However, the padding of the seat 14 may consist of cotton batting, injection molded ethylene-vinyl acetate, polychloroprene, viscoelastic polyurethane foam, or other pressure distributing materials. Additionally, the seat 14 may be covered by cotton fabric, leather, synthetic polymers, polyvinyl chloride fabric, or other materials appropriate for long-term use for furniture.

The seat 14 in the embodiment shown in FIG. 1 is round with a hemispherical contour. The round edge and elevation provided by the hemispherical shape is preferred because it allows the user to sit higher up than the standard 45 cm of traditional chairs, opening up the hips to greater than 90 degrees without cutting into the backs of the upper legs. Alternatively, shapes like a rounded triangle, bicycle saddle, or tractor seat may also allow a greater than 90 degree angle of the hips. Furthermore, a contour in the shape of a donut, or a flat or bumpy surface may achieve a high level of comfort while sitting.

Figure 2:
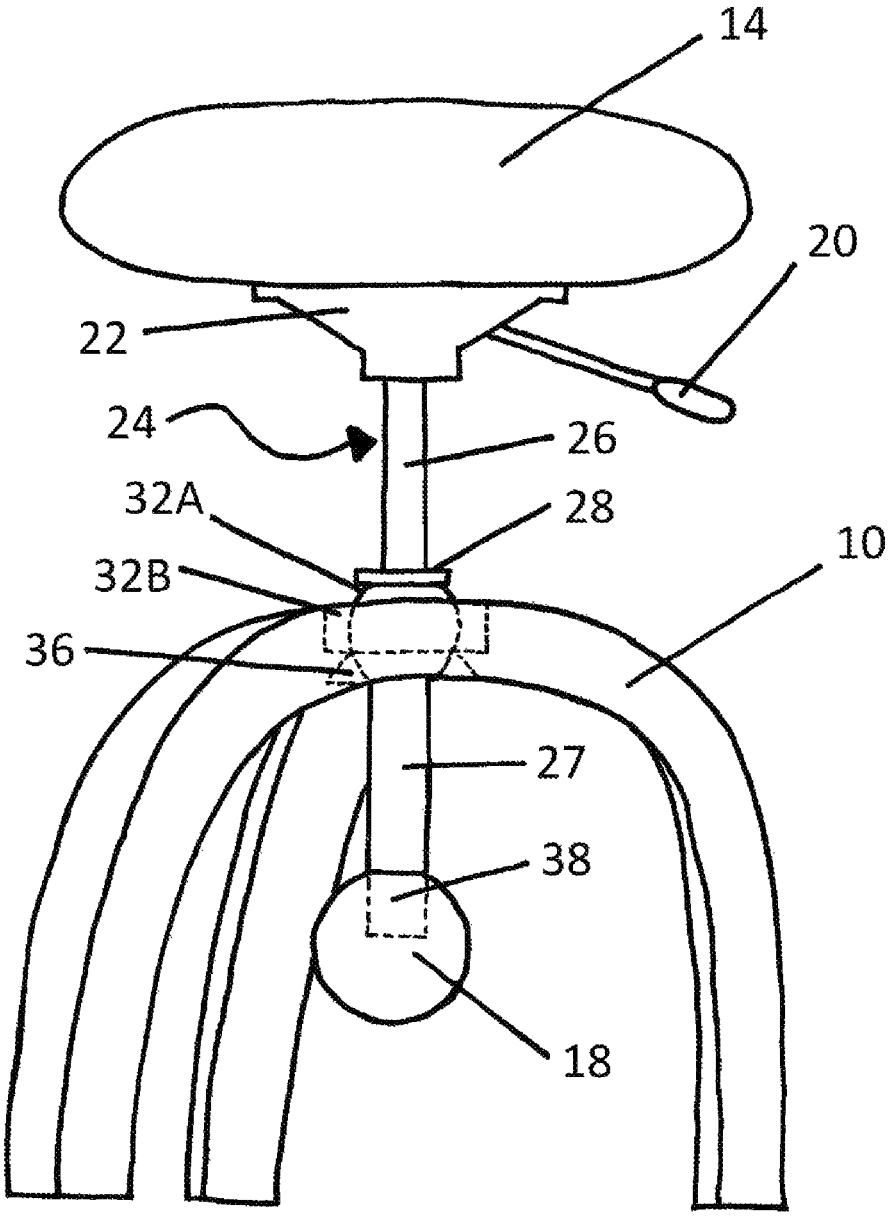
FIG. 2 is a side perspective view of the sitting device with a detailed labeling of parts.

A side perspective view of the sitting device with a detailed labeling of parts is shown in FIG. 2. The seat 14 is affixed to a mounting plate 22 which houses a lever 20 that actuates a gas lift cylinder 24. The gas lift cylinder 24 comprises a piston 26 housed within a support can 27. The counterweight 18 has a cylindrical recession 38 into which the support can 27 is affixed. The top of the support can 27 is flanged such that the flange 28 rests atop the spherical plain bearing 32A inside of which the support can 27 is affixed.

As show in the embodiment in FIG. 2, to allow the central column 12 to move at least ten degrees off of the vertical axis a conical recession 36 is made underneath the spherical plain race 32B. In this embodiment the conical recession 36 is 45 degrees relative to the vertical axis, and the diameter of the opening directly under the spherical plain race 32B is approximately 5 cm. However, the diameter and angle of the conical recession 36 may be narrowed or widened to increase or reduce, respectively, the movement of the central column 12.

Figure 3:
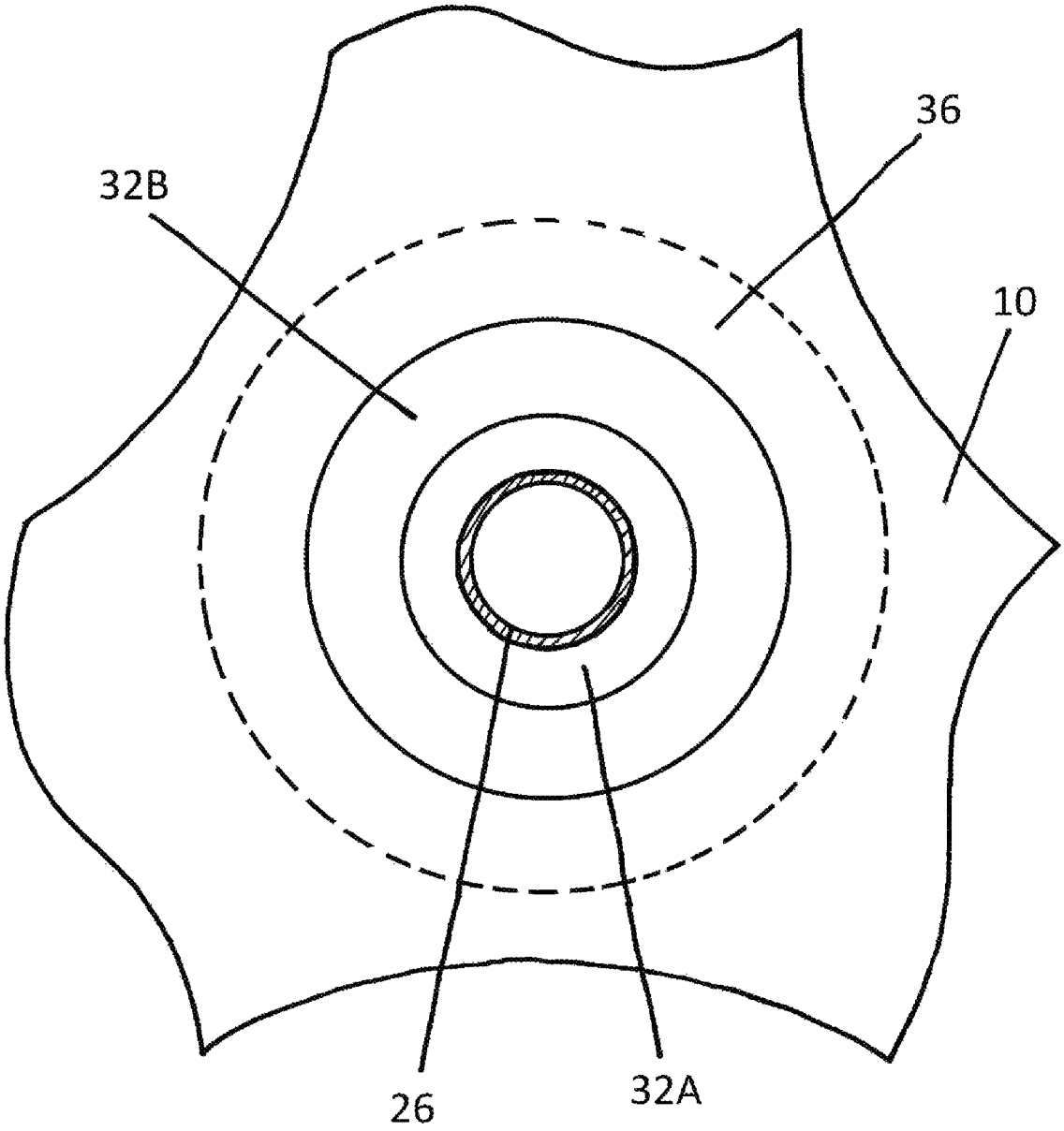
FIG. 3 is a top perspective view of the base without the seat.

A top perspective view of the base 10 without the seat 14 is shown in FIG. 3. The spherical plain bearing 32A is mounted inside the spherical plain race 32B. The circumference of the bottom of the conical recession 36 underneath the spherical plain race 32B is described by a dashed line.

In this embodiment, the base 10 is made of a single piece of laminated wood that has been formed into a three-legged structure. However, the base 10 may comprise a horizontal platform with a plurality of legs, and may be made of injection-molded polymer, metal, solid wood, or any other material sufficiently strong to bear the weight of the user.

The shape of the base 10 may vary as long as the counterweight 18 and central column 12 have sufficient space to move unimpeded.

Figure 4:
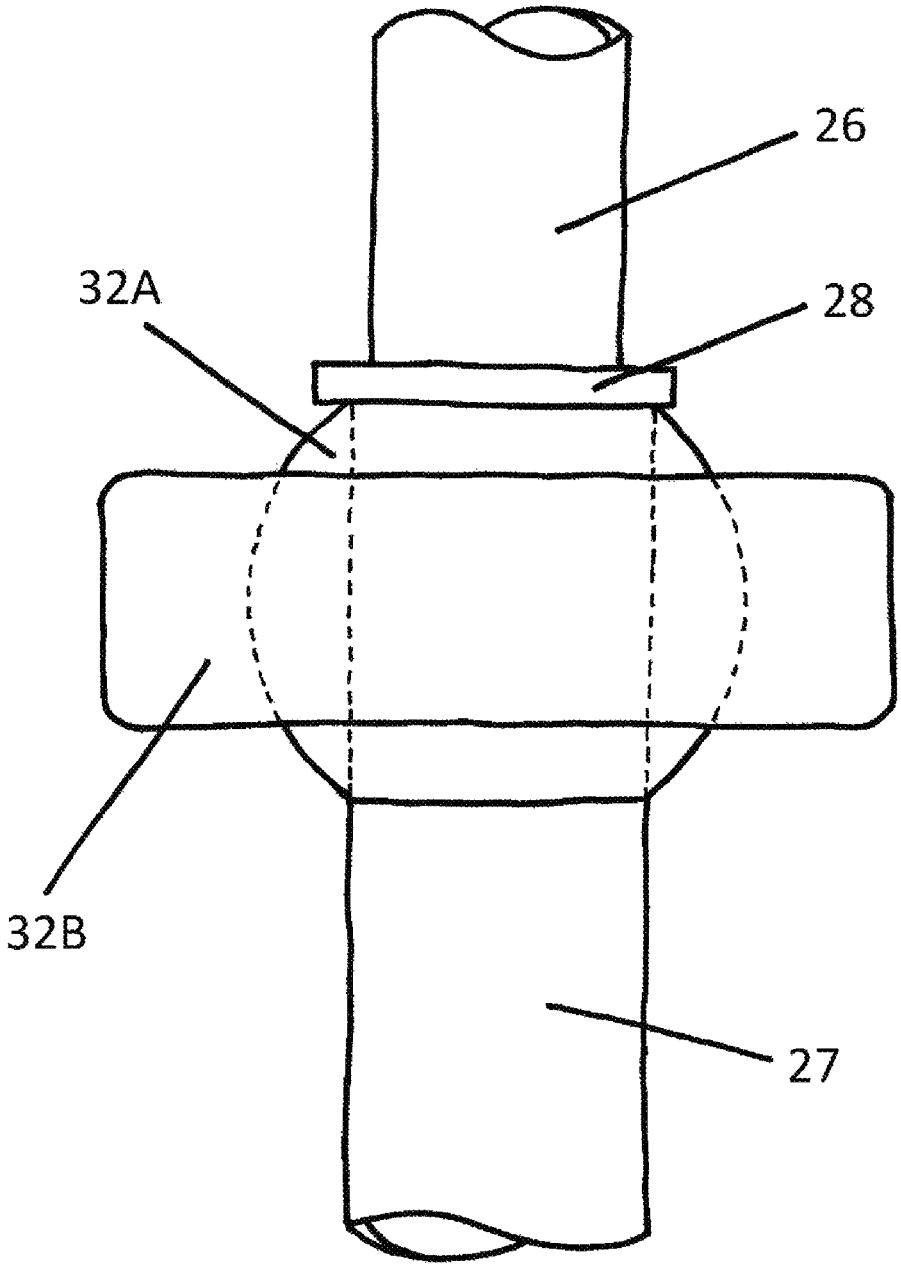
FIG. 4 is a cross-sectional side view of the pivot joint.

A cross-sectional side view of the pivot joint 16 is shown in FIG. 4. The piston 26 passes through the flange 28 at the top of the support can 27. The flange 28 rests atop the spherical plain bearing 32A, which is mounted inside the spherical plain race 32B.

The spherical plain bearing 32A and spherical plain race 32B in this embodiment are made of stainless steel with a PTFE liner (not shown) on the inside surface of the spherical plain race 32B that enhances the smooth movement of the unit without additional lubrication. Alternatively, the spherical plain bearing 32A and spherical plain race 32B may be made of nylon, composite materials, or other alloys, and similar movement may be achieved by a spherical ball bearing, gimbal bearing, spherical thrust bearing, or other means of angular movement. Lubrication of the unit may alternatively be provided with grease, liquid oils, or other lubricants.

Figure 5:
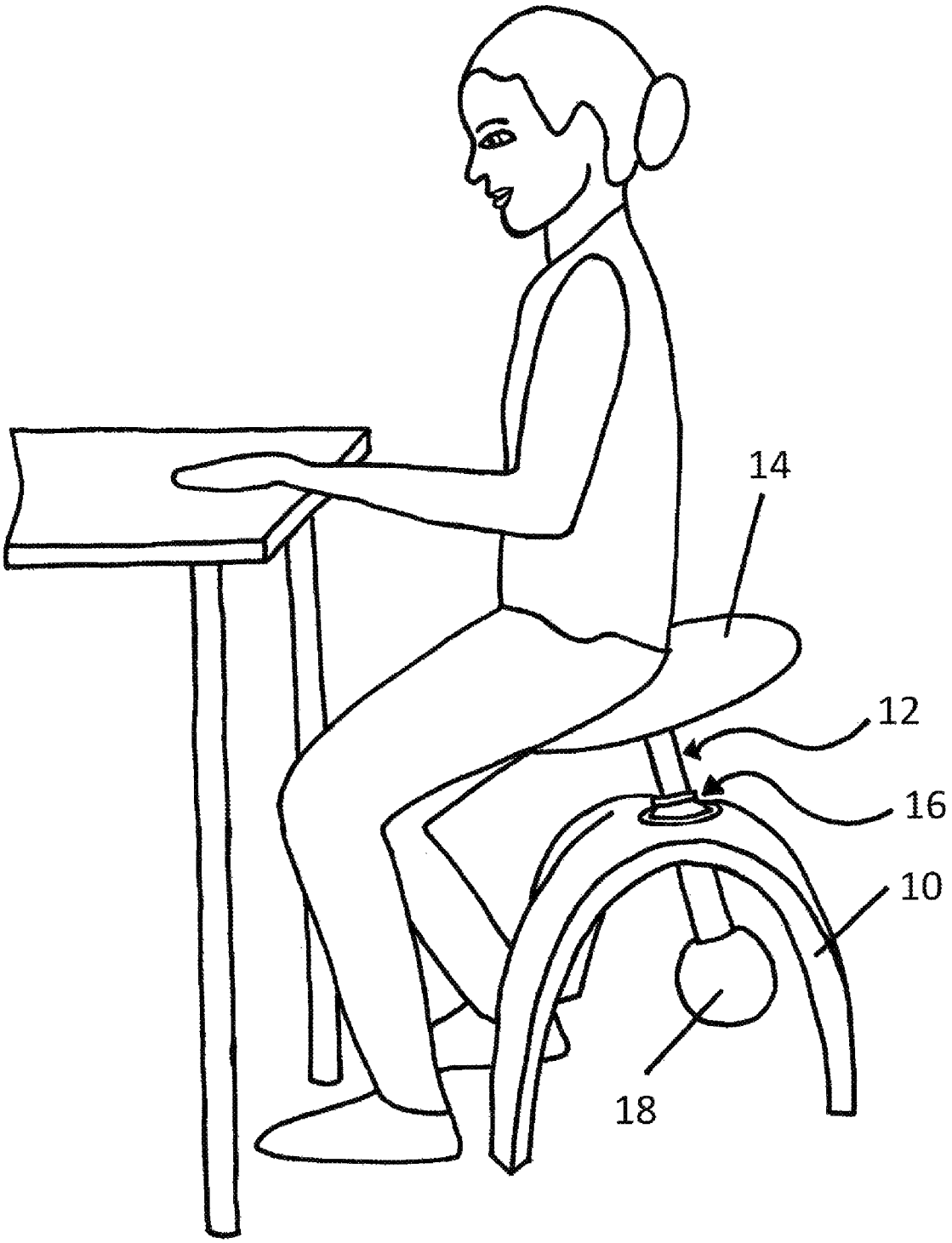
FIG. 5 is a side perspective view of a person sitting on the device.

A side perspective view of a person sitting on the device is shown in FIG. 5. When sitting on this device, the seat 14 and central column 12 tilt off of the vertical axis to accommodate the sitting position and movement of the user. To the degree that the user tilts forward, the counterweight 18 attached to the central column 12 moves angularly backward away from its central resting position directly below the pivot joint 16.

Operation

In operation, one uses the device to sit actively while working at a desk, using a computer, playing video games, playing an instrument, meditating, or otherwise practicing mindful posture. The user may adjust the height of the seat 14 using the lever 20 to actuate the gas lift cylinder 24. The user sits with the top of the seat 14 at a height approximately equivalent to the distance from the floor to the top of the user's patella when standing barefoot, between 50 and 56 cm for an average adult. Sitting at this height opens up the angle of the user's torso in relation to his or her upper legs. Furthermore, the contoured shape of the seat 14 allows for an additional opening of this angle. Taking into account the angle of the pivot joint 16 combined with the contoured shape of the seat 14, the angle of the user's torso in relation to his or her upper legs opens up to between 100 and 120 degrees.

Because of the pivot joint 16, located substantially at the median between the seat 14 and the floor, the sitting device is inherently unstable when in use. Unlike traditional and modem ergonomic chairs, while using this sitting device the user must actively monitor his or her balance to remain upright. The user creates a stable, upright sitting position by sitting centrally atop the seat 14 and carrying approximately 25 percent of his or her body weight in his or her legs.

Furthermore, the angular movement of the pivot joint 16 encourages the user to rock side to side, fore and aft, and in circular motions. Moving in this way is both enjoyable and stimulates the muscles and joints of the legs, spine, and torso. Unlike traditional sitting devices, using this device tends to enhance the user's sense of balance, increase his or her level of physical and mental activity, and provide the pleasure of moving his or her body during otherwise physically passive activities.

Figure 6:
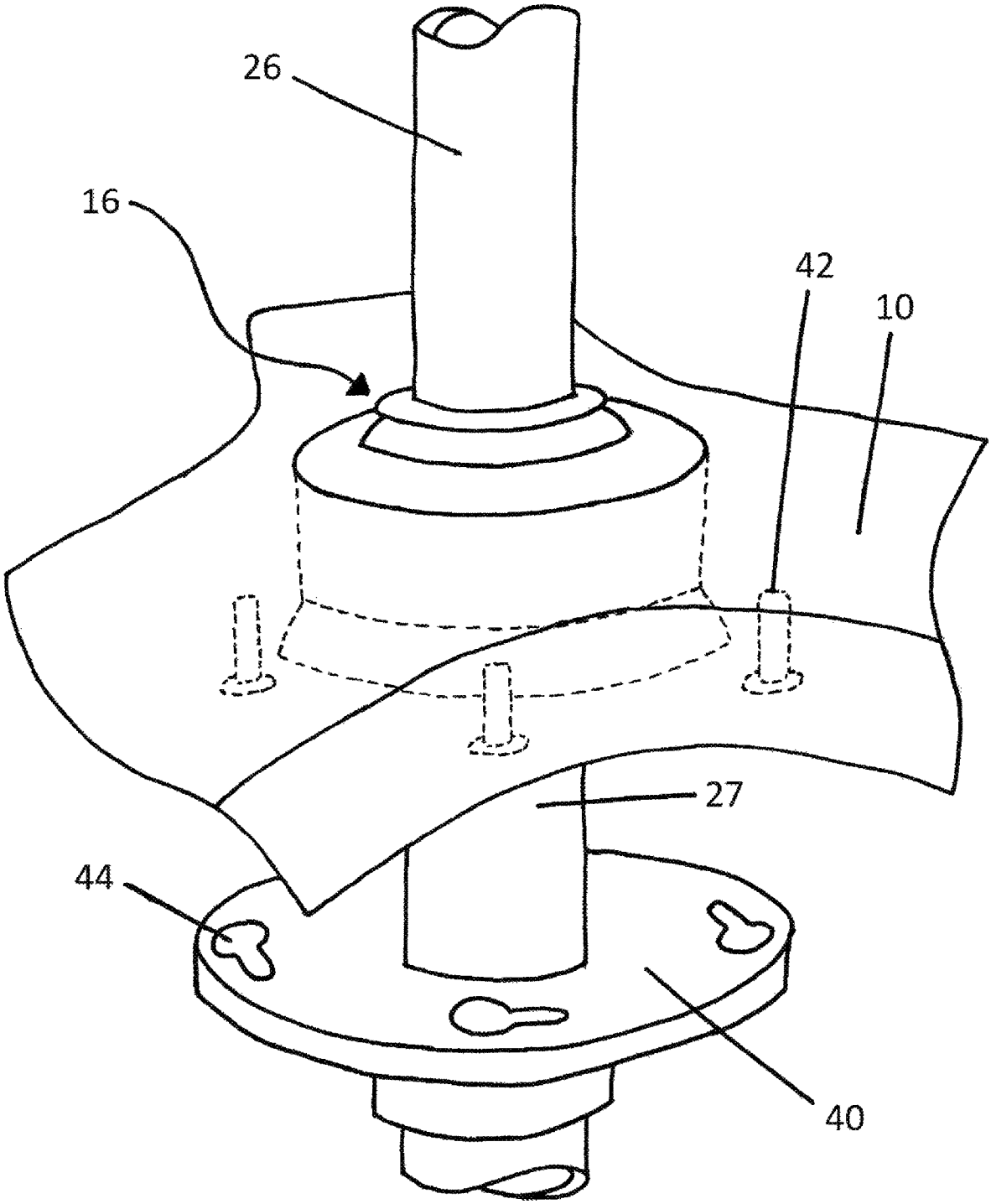
FIG. 6 is an isometric view of one embodiment with a collar lock

Additional Embodiments—FIG. 6

An embodiment of the sitting device with a collar lock is shown in FIG. 6 (isometric view). In accordance with this embodiment, a collar lock 40 with keyhole slots 44 is mounted below the pivot joint 16 along the central column 12 and twist-locks onto four pan head screws 42 along the underside of the base 10. Alternatively, a plurality of keyhole slots 44 and pan head screws 42 could be used to secure the collar lock 40. By twisting the collar lock 40 clockwise into place on the pan head screws 42, the user is able to inhibit the movement of the central column 12.

Figure 7:
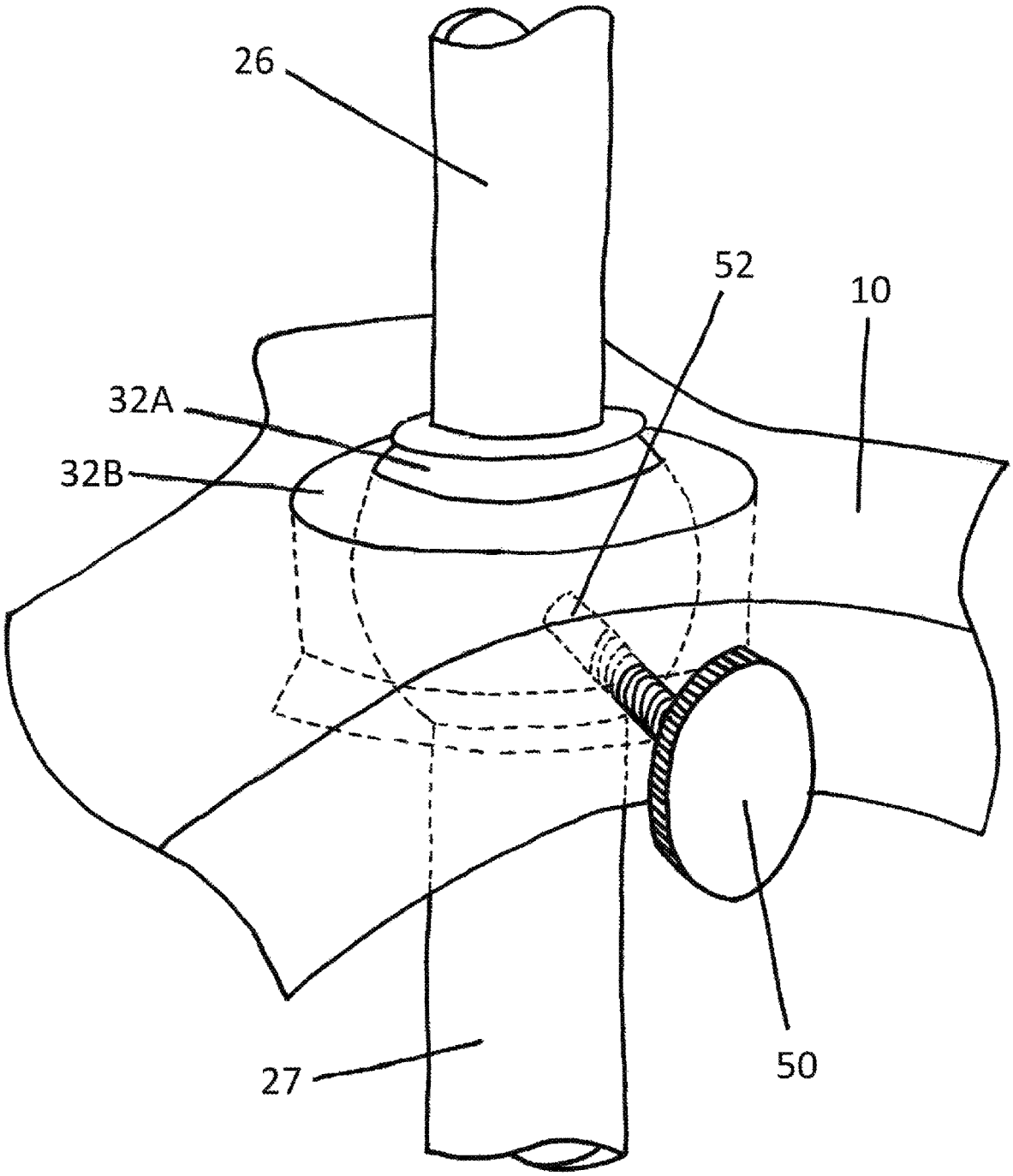
FIG. 7 is an isometric view of one embodiment with a set screw

Alternative Embodiments—FIG. 7

An embodiment of the sitting device with a set screw is shown in FIG. 7 (isometric view). In accordance with this embodiment, a threaded hole 52 passes in line through the side of the base 10 and the side of the spherical plain race 32B. A set screw with knob handle 50 is screwed into the threaded hole 52 aligned with the center of spherical plain bearing 32A. By installing the set screw with knob handle 50 perpendicular to the angular movement of the bearing, the user is able to increase friction between the spherical plain bearing 32A, spherical plain race 32B, and the set screw with knob handle 50 itself, thereby reducing or completely inhibiting the movement of the spherical plain bearing 32A. Alternatively, resistance to the movement of the spherical bearing 32A may be adjusted using a lever or other device that may be used to apply pressure.

Advantages

From the description above, a number of advantages of some embodiments of my sitting device become evident:

(1) Allows for the pivotal movement of the seat 14 and central column 12 from 10-20 degrees off of the vertical axis so the user's hips can be open and mobile while his or her upper body and head remain vertically aligned.
(2) Allows for movement in the user's pelvis and lumbar, thoracic, and cervical spine.
(3) Requires the user to carry part of his or her weight in his or her legs to remain upright.
(4) Encourages the user to maintain the vertical posture of his or her torso without the support of a back rest.
(5) Encourages the user to actively monitor his or her balance and posture to remain sitting in the upright position.
(6) Offers the user minimal resistance to moving the seat 14 and central column 12 off of the vertical axis relative to his or her body weight.
(7) The seat 14 and central column 12 return to upright when the user is not sitting on the device.
(8) This device is able to stand on its own.
(9) The degree of angular movement of the pivot joint 16 may be limited as desired.
(10) The movement of the pivot joint 16 may be inhibited as desired.
(11) The frictional resistance of the pivot joint 16 may be adjusted as desired.

CONCLUSION, RAMIFICATIONS, AND SCOPE

Accordingly, the reader will see that embodiments of the sitting device encourage active, dynamic sitting in the user and an increased attention to maintaining upright posture. Additionally, when the user is not sitting, the sitting device stands on its own, and the seat and central column return to vertical without him or her needing to reposition them. Furthermore, the embodiment with a column lock has additional advantages in that:

- they allow users to lock the seat and central column into place if he or she prefers to sit on a static sitting device, and
- they provide a safety measure to reduce the likelihood that new users or those unfamiliar could be injured attempting to sit on the device.

Additionally, the embodiments with a set screw inserted through the side of the race, extending toward the center of the spherical plain bearing have additional advantages in that:

they allow new users and those with a less acute sense of balance to control the rate of movement of the central pivot, and they allow users to reduce the amount of activity required to sit for long periods of time by making the sitting device less dynamic.

Although the description above contains many specificities, they should not be construed as limiting the scope of the embodiments but as merely providing illustrations of some of several embodiments. For example, the seat can be configured in many shapes and sizes such as saddle-shaped or a rounded triangle, and the contours of the seat can be that of a donut, flat, or bumpy. The central pivot may be a spherical ball bearing, spherical thrust bearing, or other device that allows the central column and seat to move, and it may be lubricated by liquid oils, dry lubricants, or other means of lubrication. The base may be constructed as a single three-dimensional unit or with connected pieces such as legs and a horizontal surface in which to mount the central pivot, and it may be constructed of plastic, wood, rubber, or other materials of various properties, colors, and textures.

Thus the scope of the embodiments should be determined by the appended claims and their legal equivalents, rather than by the examples given.

I claim:

1. A sitting device, comprising:

a base, a central column supported by said base, a seat attached to said central column, means for permitting pivotal movement of said central column located substantially at the median of said central column between said seat and bottom of said base, and means for returning said central column to upright when said sitting device is not being used.

2. The sitting device of claim 1 wherein said base is a three-dimensional structure with a flat bottom so that said sitting device will not roll or move when resting on the floor.

3. The sitting device of claim 1 wherein said base comprises a plurality of elongated supports of equal length affixed perpendicularly to a sheet of rigid material sufficient in strength to support the weight of a person.

4. The sitting device of claim 1 wherein said seat is shaped to accommodate a person on said sitting device.

5. The sitting device of claim 1 wherein the seat is contoured to accommodate a person to sit on said sitting device.

6. The sitting device of claim 1 wherein the padding of said seat is made of polyethylene foam, injection molded ethylene-vinyl acetate, polychloroprene, viscoelastic polyurethane foam, organically produced batting, or other pressure distributing materials.

7. The sitting device of claim 1 wherein said seat is covered by cotton fabric, leather, synthetic polymers, polyvinyl chloride fabric, or other materials appropriate for long-term use for furniture.

8. The sitting device of claim 1 wherein the length of said central column includes adjustable means for elongation and retraction of said central column.

9. A sitting device, comprising:

a base, a central column supported by said base, a seat attached to said central column, means for permitting pivotal movement of said central column located substantially at the median of said central column between said seat and bottom of said base, means for returning said central column to upright when said sitting device is not being used, and means for inhibiting said pivotal movement of said central column.

10. The sitting device of claim 9 wherein said means of inhibiting the pivotal movement of said central column is achieved by a locking collar.

11. A sitting device, comprising:

a base, a central column supported by said base, a seat attached to said central column, means for permitting pivotal movement of said central column located substantially at the median of said central column between said seat and bottom of said base, means for returning said central column to upright when said sitting device is not being used, and means of adjusting the frictional resistance to said pivotal movement of said central column.

12. The sitting device of claim 11 wherein said means of adjusting the pivotal movement of said central column is achieved by a set screw, lever, or other mechanical device.

* * * * *